US005398938A

United States Patent [19]

Money

[11] Patent Number: 5,398,938

[45] Date of Patent: Mar. 21, 1995

[54] GAME APPARATUS

[76] Inventor: Henty V. Money, 254 Marine Parade, Swanbourne, Western Australia, Australia, 6010

[21] Appl. No.: 151,200

[22] Filed: Nov. 12, 1993

[30] Foreign Application Priority Data

Nov. 12, 1992 [AU] Australia ..... PL5780

[51] Int. Cl.[6] ..... A63F 3/00

[52] U.S. Cl. ..... 273/237; 273/239; 273/86 B; 273/246

[58] Field of Search ..... 273/86 B, 86 E, 86 F, 273/239, 246, 237

[56] References Cited

U.S. PATENT DOCUMENTS 2,133,165 10/1938 Eisenberg et al. ..... 273/86 F
2,555,785 6/1951 Cook ..... 273/86 F
3,441,277 4/1969 Winn ..... 273/86 F
3,709,493 1/1973 Lally ..... 273/86 F
3,767,202 10/1973 Sternad ..... 273/239
3,815,912 6/1974 Wichinsky et al. ..... 273/86 F
3,985,357 10/1976 Miller ..... 273/86 G
4,033,587 7/1977 Oliver ..... 273/246

*Primary Examiner*—Benjamin H. Layno

[57] ABSTRACT

A game apparatus which is suitable for card games simulates racing and is easily adapted to gambling. One of the card games which may be played on the apparatus is Cartes-Chevaux. The apparatus includes a playing region and a plurality of playing pieces which are movable on an upper playing surface of the playing region. A mobile element located below the playing region controls movement of the playing piece. The mobile elements are automatically movable along or adjacent to guide rails by a controller.

10 Claims, 7 Drawing Sheets

GAME APPARATUS

FIELD OF THE INVENTION

This invention relates to a game apparatus. In particular, the invention relates to a game apparatus which is suitable for use with a card game of a type which simulates racing and which is easily adapted for gambling and thus for use in a casino or the like.

DESCRIPTION OF THE BACKGROUND ART

There are many manually operated games available that are based on the use of a number of game pieces racing against each other to a particular point, the movement of the pieces being determined by a random number generator of some type and the movement being manually effected by a player. These games are traditionally domestic and have not been successfully adapted for use in casinos or other such gaming venues, particularly as manually operated game boards necessitate the incorporation of structural aids in the form of guide rails, slotted tracks or visible markings relative to distance, all of which are generally visible thereby emphasising a domestic standard or usage.

Indeed, games which require "hands on" involvement of players are avoided at casinos for obvious security reasons. Furthermore, even where such games have been able to be adapted for operation by a single person only, the involvement of the operator in continually moving pieces has proven to be debilitating.

One card game with which the game apparatus of the present invention finds particular use is a recently developed card game called "Cartes-Chevaux". Prior to describing the game apparatus of the invention, it will be beneficial to describe this card game. However, it must be appreciated that the game apparatus of the invention is not to be limited to use only with this particular card game.

The general form of the Cartes-Chevaux card game utilises a standard deck of 52 playing cards, modified by removing one card from the spades suit, two cards from each of the diamonds and clubs suits and three cards from the hearts suit. The remaining 44 cards are thoroughly shuffled. A dealer then commences turning the top card on the modified deck face up and continues to do so. As each card is turned, it is placed onto one of four piles, one pile for each suit. The first pile to receive, for example, eight cards, defines the winning suit (be it hearts, diamonds, clubs or spades). Because a different number of cards from each suit is left the in the pack, there is a different probability that each suit would win—spades being most likely to win and hearts least likely. A main feature of the game from a betting point of view is that the game preferably does not conclude until the second placing is determined, thereby introducing twelve different possible orders of finish. Spectators may thus gamble on the possible outcomes, the odds offered to them being in inverse proportion to the probability of each possible outcome.

For the purposes of entertainment, the game may be presented as a race. In this respect, four markers enter the race, each carrying a respective suit, be it hearts, clubs, spades or diamonds. The markers are lined up at a starting line and advance one move every time a card of the respective suit is played. Thus, when a heart appears, the marker representing hearts advances one move. The game may thus be adapted for use with markers and with some form of "race track" which defines a starting point and a finishing point. The first marker to advance the required number of moves from the starting point to the finishing point wins the race.

The game can be played with variable modifications to the deck and also with a varied number of moves along the track required to complete the course.

SUMMARY OF THE INVENTION

An aim of the present invention is to provide a game apparatus which is capable of automating such a card game so as to reduce the "hands on" involvement of an operator and so as to make the card game an attractive and viable game for use by casinos and other gambling venues. In this respect, it will be seen that by utilising the game apparatus of the present invention, a card game such as Cartes-Chevaux may be played having a minimum of ungainly and unsightly guiding or supporting mechanisms and which allows easy and relatively unrestricted viewing by the players.

The present invention provides a game apparatus which comprises a playing region, having an upper playing surface and a lower interacting surface, and a plurality of playing pieces, each playing piece capable of being supported on the playing surface for movement therealong, the movement of each playing piece being controlled by a respective mobile element located below the playing region adjacent to the interacting surface, each mobile element being associated with a control means which, on activation thereof, causes its respective mobile element to move a predetermined distance along the interacting surface to cause a respective playing piece to move correspondingly along the playing surface.

In a preferred form, the association between each playing piece and a respective mobile element is effected by magnetic attraction therebetween. The magnetic attraction may be provided by including magnets within each of the mobile elements and the playing pieces, or alternatively the magnetic attraction may be provided by including magnets on one only of the mobile elements or the playing pieces and then including within the other of the mobile elements or the playing pieces a magnetically attractive material.

The playing region is preferably an elongate rectangular playing region which includes a substantially smooth and flat upper playing surface. The playing surface may or may not have visual markings thereon which define a plurality of straight tracks therealong. However, it is preferred that there are no visible markings, the surface simply being of a size that is suitable to allow parallel movement therealong of a number of playing pieces.

Preferably, four tracks are provided which will allow the playing surface to be used in conjunction with the Cartes-Chevaux card game described above, one track being for each of the respective suits of a deck of cards.

In this form, each of the mobile elements are preferably constrained below the playing region for movement in the direction of and along the full length of those same plurality of straight tracks, there being one mobile element per track. Thus, by moving a mobile element along underneath the playing region, when a playing piece is located immediately thereabove, the magnetic attraction therebetween causes the playing piece to also move along the playing surface of the playing region.

In one particular form of the present invention, the mobile elements are movable along or adjacent to guide rails which define channels. The mobile elements are connected at either end thereof by cords via pulleys to a motor operable to cause movement of the mobile element in one or other direction along the channel. In this respect, each channel will include its own independent mechanism for moving the mobile element therein and thus if four channels are provided there will be four mobile elements, four sets of cords and pulleys, and four motors.

The operation of the motors is preferably such that, when activated, the motor causes the mobile element to commence movement along the channel. In this form, by providing conductive sensors arranged at predetermined distances along the channels, the mechanism may be adapted such that contact of a mobile element with the conductive sensors deactivates the motor to cause the mobile element to stop at that position. Thus, by providing a number of conductive sensors at equal predetermined distances along the length of the channel, the movement of the mobile elements may be controlled to be in a predetermined number of steps. For instance, by providing eight sets of conductive sensors, the motor of a mobile element must be activated eight times to move the mobile element, in steps, along the eight positions of its respective channel. Therefore, by providing a switch in the form of an activating button for the motor in each channel, an operator is able to select movement of a mobile element in a particular channel at will.

Thus, by associating a playing piece with each mobile element below the playing region, the playing pieces may similarly be moved the same stepped predetermined distances along the playing surface in response to the movement of the mobile element associated therewith. In this way, by using small and relatively silent motors, by providing smooth undersides for the playing pieces and by providing a felt surface or the like for the playing surface of the playing region, the movement of the playing pieces is smooth and silent. There are no visible guide or support systems and the only movement visible to players is that of the playing pieces moving along a flat surface in response to the operator pushing a button for a respective playing piece. There is then no need for player involvement, nor is there any need for the operator to be reaching across the playing region, or about the surface of a table holding the playing region, other than for the normal placement of bets and paying of winnings. The operator therefore simply handles the modified deck of cards (for the Cartes-Chevaux game described above) and pushes the relevant buttons for the correct playing pieces until the first and second playing pieces have crossed the finish line. A preferred feature of the invention allows the winning playing piece to complete one standard full move beyond the finish line, whereas the second playing piece to complete the race will automatically be restricted to a half move across the finish line.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will now be described in relation to a preferred embodiment illustrated in the accompanying drawings. However, it must be appreciated that the following description is not to limit the generality of the above description.

In the drawings.

DETAILED DESCRIPTION OF THE PREFERRED EMBODIMENTS

Figure 1:
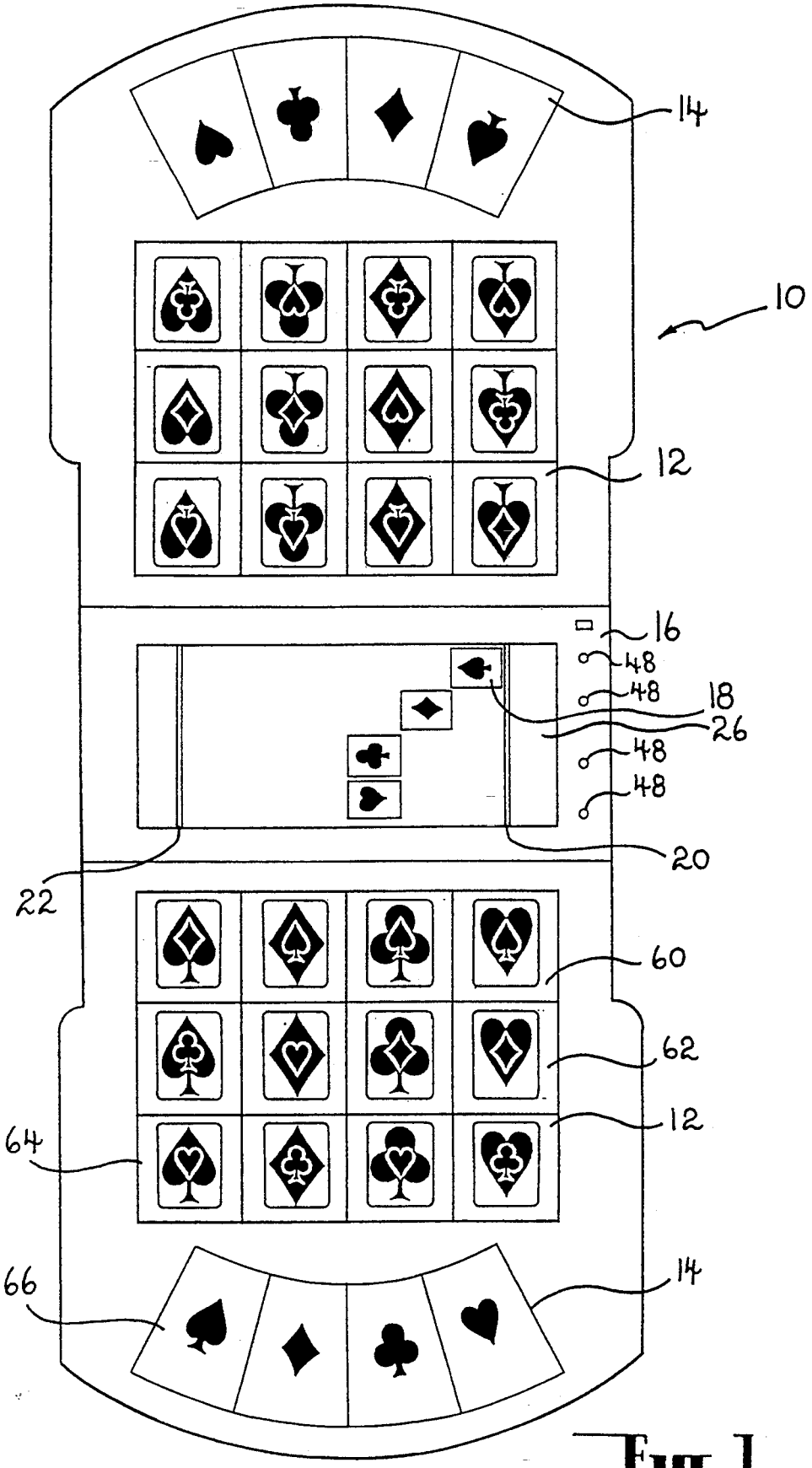
FIG. 1 is plan view of an example of a game table showing the playing region of the game apparatus of the present invention.

The preferred embodiment illustrated in FIG. 1 provides an entertaining and attractive representation of the game Cartes-Chevaux as described above. The display takes the form of a gaming table 10 which permits players to place bets on the result of the game in the betting areas indicated by the numerals 12 and 14. The gaming table 10 includes a playing region 16.

As described above, for the purposes of entertainment, the card game known as Cartes Chevaux is presented as a horse race conducted between a set of four playing pieces 18. The four playing pieces enter the race, each one bearing the indicia denoting its suit (i.e., a red heart, a red diamond, a black club or a black spade). The four pieces are lined up at the starting line 20 and advance one move each time a card of the respective suit is turned over from the top of the modified deck of cards described above. Thus, when any card of the hearts suit is turned over by the operator, the playing piece carrying the heart advances one move.

Thus, the first piece to advance the required number of moves and pass the finishing line 22 wins the race.

Figure 3:
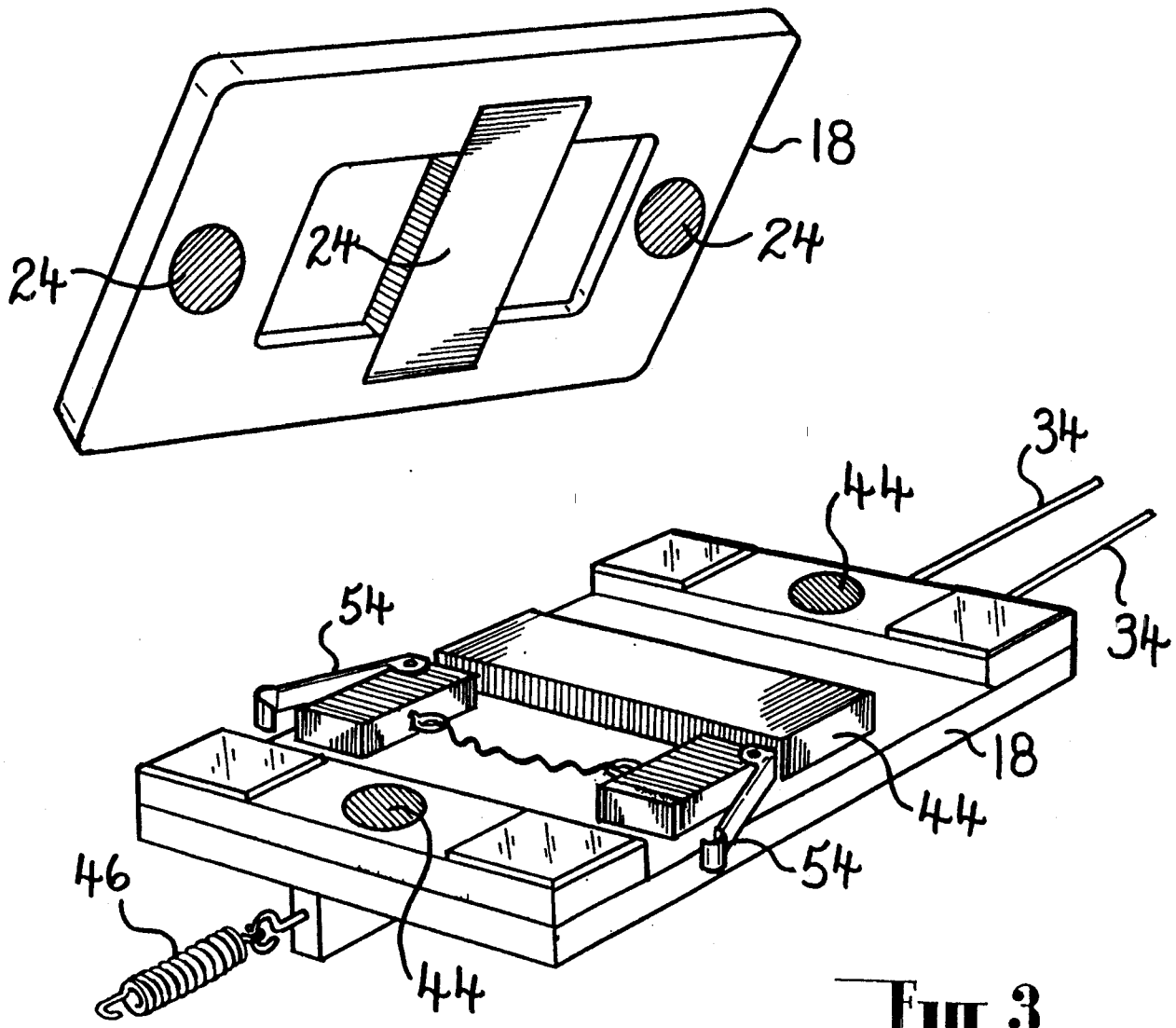
FIG. 3 illustrates the relationship between a mobile element and the underside of a playing piece.

As is evident from both FIG. 1 and FIG. 3, each playing piece 18 preferably consists of a rectangular block of an acrylic material, the top of which bears the relevant indicia. The underside of each piece accommodates a set of permanent magnets 24, the use of which will be described below. As is also evident from FIG. 1, the playing pieces 18 are shown as being movable along the upper playing surface 26 of the playing region 16 in straight lines therealong, the straight lines being equated with "tracks" along which the pieces may "run". Further, the playing surface 26 is provided as an artificial felt surface of a similar material to that commonly used on gaming tables in casinos and the like.

Figure 2:
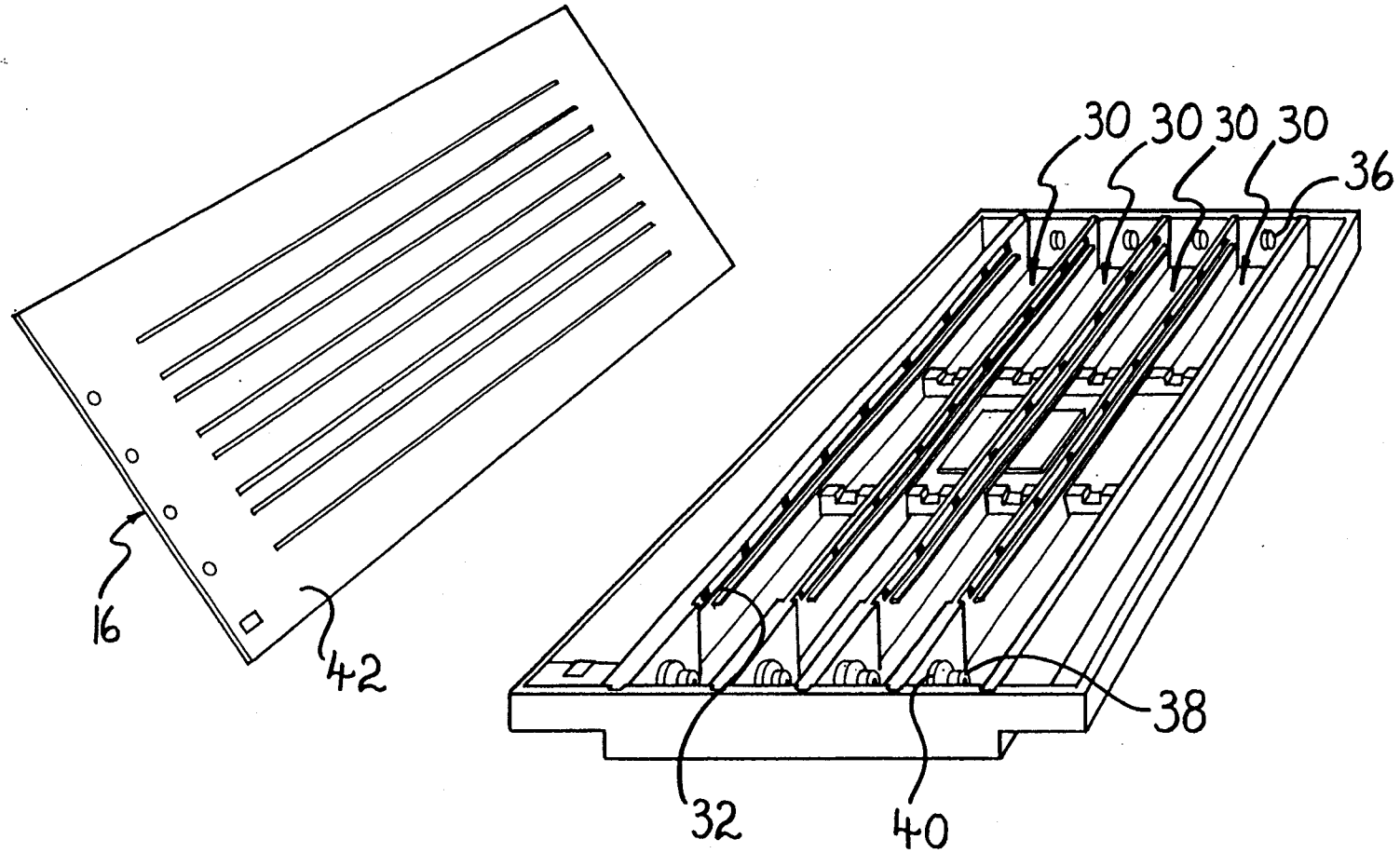
FIG. 2 is a schematic perspective view of the underside of the playing region and the mechanisms therebelow.
Figure 4A:
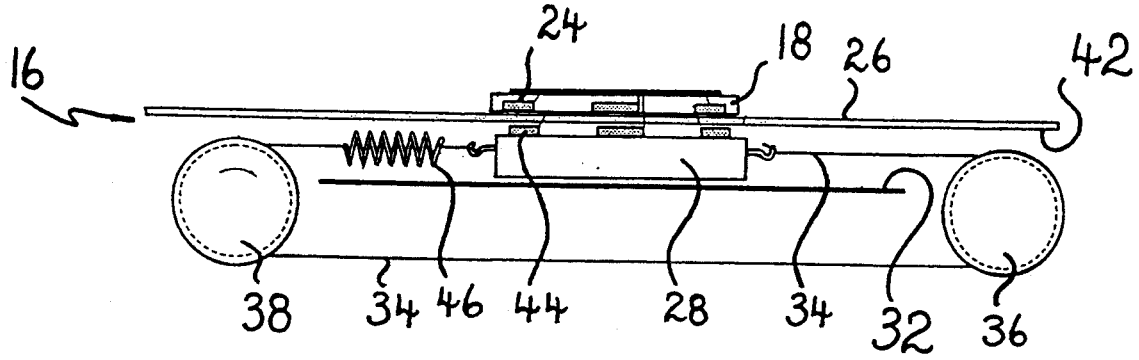
FIGS. 4*a* and 4*b* illustrate sectional views of the interaction of the playing region between a playing piece and a mobile element.
Figure 4B:
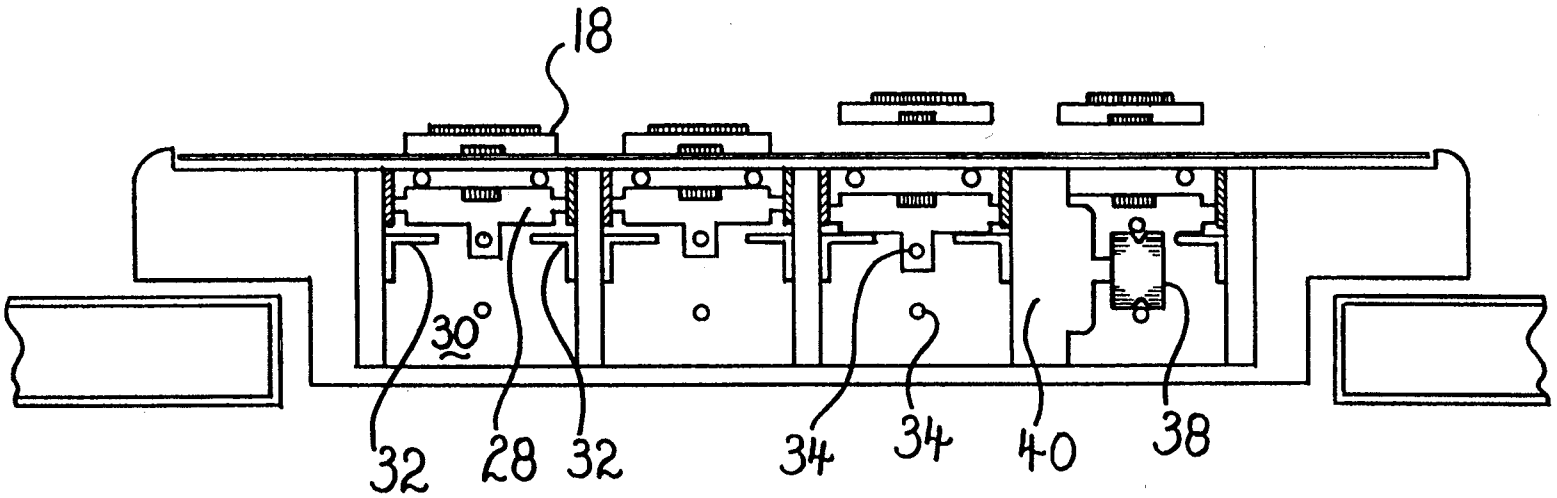

In FIGS. 2, 4*a* and 4*b*, the relationship of the mobile elements 28, the playing pieces 18, the playing surface 26 and the channels 30 is better illustrated.

Each mobile element 28 moves along rails 32 provided along the sides of channels 30. Either end of the mobile element 28 is attached to a cord 34 which travels about an idler pulley 36 and a drive pulley 38 at either end of the channel 30. The drive pulley 38 is rigidly secured to a motor 40 in order to provide motorised movement of the mobile element 28.

With regard to the illustration of FIG. 4*b*, the channel which appears at the right hand side of the drawing is illustrated showing the motor 40 and pulley 38 located at one end thereof, whereas the other three channels in the drawing are shown as sections through the channel which thus show the cord 34 simply as circles.

The rail 32 upon which the mobile element 28 may rest is configured such that the upper surface of a mobile element 28 is located adjacent to and below the lower interacting surface 42 of the playing region 15. Thus, the magnets 24 of the playing piece 18 are attracted by the magnets 44 of the mobile element 28 such that movement of the mobile element 28 along and above the rails 32 causes corresponding movement of the playing piece 18 along the playing surface 26. It will also be noticed that a spring 46 is provided within the line of the cord 34 in order to maintain a desired level of tension in the cord 34. The tension may thus be adjusted by adjusting the length of the cord, which is preferably attended to by adjusting an adjusting screw (not shown) via which the cord is secured to the mobile element.

The activation of each motor 40 is controlled by an electronic control (not shown) which comprises a switch (48 illustrated in FIG. 1) activated by the operator in charge of the game, a switch being provided for each of the playing pieces. The switches 48 and their associated circuitry cause the motor to drive a respective playing piece the correct distance to advance the mobile element 28 one move in a forward direction for each time the switch is closed. In this embodiment, each move would correspond to one eighth of the track length. There may also be a controlling switch which reverses the polarity of the current such that the operation of the switches then causes a reverse motion of the mobile element that preferably causes the mobile element to return to its starting position in a single continuous movement.

The switch is thus moved by the operator to advance the respective playing pieces after each card is played and to return the playing pieces to the starting line for the next game.

Figure 6:
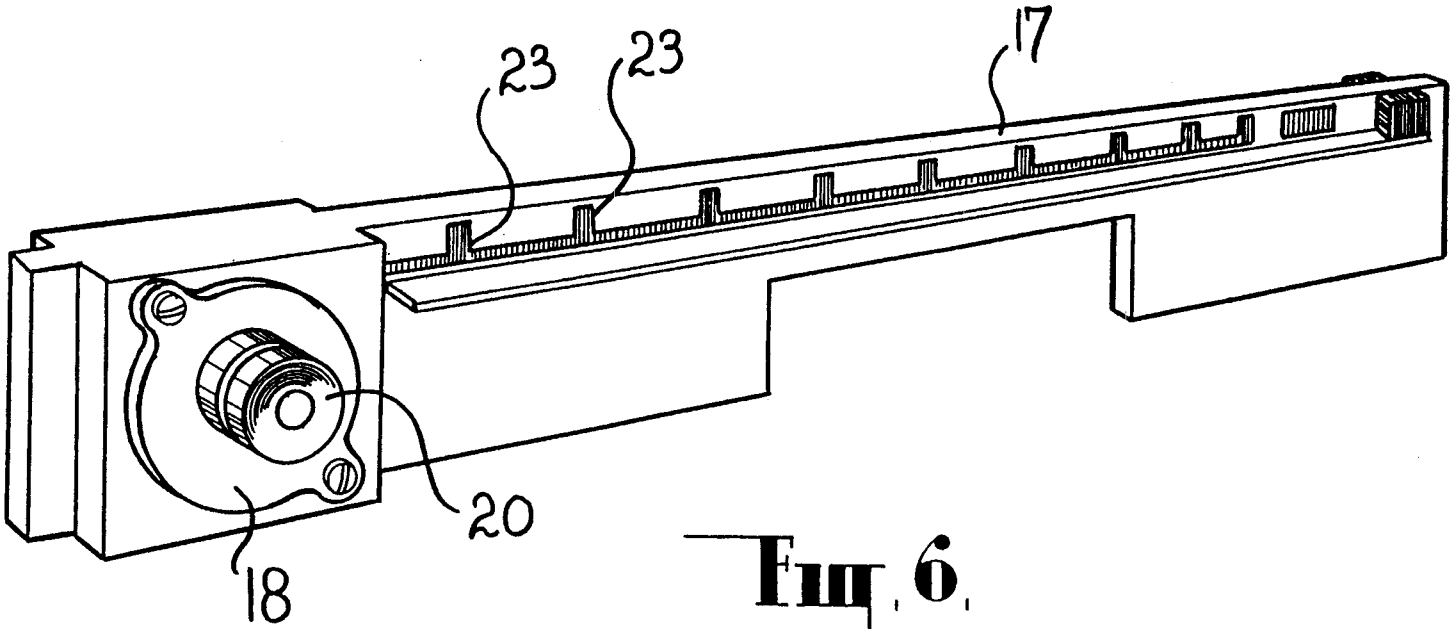
FIG. 6 is a perspective view of a portion of a channel for a mobile element.

To ensure the accuracy of each move, the circuitry associated with the switches comprises an array of electrical contacts 50 (see FIG. 6) along each side of the channel walls 52 such that the mobile element travelling therealong may be stopped at the correct position after each move. In this respect, when the mobile element reaches one of the intended positions, the electrical contacts 54 (see FIG. 3) on each side of the mobile element are electrically interconnected with each other via the mobile element to complete an electrical circuit which thus causes the control circuit to stop the movement of the motor driving the mobile element. The control circuit is such that on the first piece moving one full move beyond the finish line, the second piece will only move one half a move past the finish line and no other pieces may move past the finish line. Therefore at the conclusion of the race there is a clear indication of first and second place.

Figure 5:
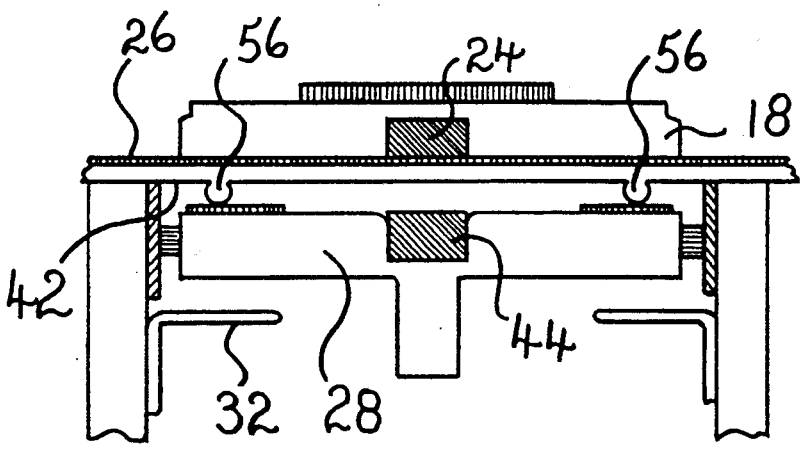
FIG. 5 is a part exploded view of the relationship illustrated in FIG. 4*b*.

Further, and as shown in FIG. 5, the lower interacting surface 42 supports a pair of rods 56 which run parallel to the channels 30. The rods 56 are provided to maintain a spacing between the mobile elements 28 and the lower interacting surface 42 in order to minimise the friction between the mobile elements and the surface.

Of course, it will be appreciated that the precise configuration of the electrical circuitry may be modified as necessary and may be provided in any form provided that the required degree of movement is obtainable by an operator simply by the push of a button. Further, the precise layout of the upper surface of the gaming table may be altered as necessary and in conjunction with the particular game being played, or in order to alter the odds available to players. In this respect, the layout provided in FIG. 1 provides a player with the ability to place bets on both first and second place, the indicia in area 60 having the larger indication of the heart indicating that hearts will win while the smaller indication of the spade indicates that the spade will come second. Further, the indicia in area 62 indicates that hearts will come first and diamonds will come second, while, for example, the indicia in area 64 indicates that spades will come first and hearts will come second. Of course, the standard indicia in region 66 may simply be used for a player to bet only on the winner of the race. Nonetheless, and as indicated above, the layout of the table may be altered as necessary.

It will also be appreciated that in use the game apparatus may be used with any type of random number generator which is capable of randomly determining which mobile element should be advanced. For example, the deck of cards may be replaced by a computer guided system which may be automated to randomly select which mobile element is to be advanced, until the conclusion of the game. Other alternatives may also be available.

It is thus apparent that the present invention provides a game apparatus which allows for the full working mechanism to be hidden from view and which allows for silent and smooth running as would be required in order to provide a game that was attractive to gambling establishments and also to gamblers in general. The game apparatus is readily adaptable for use with any appropriate game, such as card games, and in particular with the card game known as Cartes-Chevaux.

Finally, it will be appreciated that there may be other variations and modifications to the apparatus described herein that are also within the scope of the present invention as defined by the following claims.

I claim:

1. A game apparatus which comprises a playing region, having an upper playing surface and a lower interacting surface, and a plurality of playing pieces, each playing piece being supportable on the playing surface for movement therealong, the movement of each playing piece being controlled by a respective mobile element located below the playing region adjacent to the interacting surface, each mobile element being associated with a control means which, on activation thereof, causes its respective mobile element to move a predetermined distance along the interacting surface to cause a respective playing piece to move correspondingly along the playing surface, the mobile elements being constrained below the playing region for movement in the direction along the full length of the playing region, the mobile elements being movable along or adjacent to guide rails which define channels.

2. The game apparatus according to claim 1, wherein the association between each playing piece and a respective mobile element is effected by magnetic attraction therebetween.

3. The game apparatus according to claim 2, wherein the magnetic attraction is provided by including magnets within each of the mobile elements and the playing pieces, or alternatively by including magnets on one only of the mobile elements or the playing pieces and then including within the other of the mobile elements or the playing pieces a magnetically attractive material.

4. The game apparatus according to claim 1, wherein the playing region is an elongate rectangular playing region which includes a substantially smooth and flat upper playing surface.

5. The game apparatus according to claim 1, wherein the mobile elements are connected at either end thereof by cords via an idler pulley and a drive pulley, the drive pulley being connected to a motor operable to cause movement of the mobile element in one or other direction along the channel.

6. The game apparatus according to claim 5, wherein the motor causes the mobile element to commence movement along the channel, and wherein conductive sensors are arranged at predetermined distances along the channel such that contact of a mobile element with a conductive sensor deactivates the motor to cause the mobile element to stop at that position.

7. The game apparatus according to claim 1, wherein a random member generator is used to determine and control the activator of each control means.

8. The game apparatus according to claim 7, wherein the random number generator is a shuffled and modified deck of cards.

9. The game apparatus according to claim 7, wherein the random number generator is a computer.

10. The game apparatus according to claim 1, wherein the game being played is Cartes-Chevaux.

* * * * *